US009562360B2

(12) United States Patent
Brailsford et al.

(10) Patent No.: US 9,562,360 B2
(45) Date of Patent: Feb. 7, 2017

(54) CONCRETE MOSAIC

(71) Applicant: Lithocrete, Inc., Costa Mesa, CA (US)

(72) Inventors: Robin Brailsford, Dulzura, CA (US); Ronald D. Shaw, Corona Del Mar, CA (US)

(73) Assignee: LITHOCRETE, INC., Costa Mesa, CA (US)

( * ) Notice: Subject to any disclaimer, the term of this patent is extended or adjusted under 35 U.S.C. 154(b) by 0 days.

(21) Appl. No.: 15/011,947

(22) Filed: Feb. 1, 2016

(65) Prior Publication Data

US 2016/0145874 A1 May 26, 2016

Related U.S. Application Data

(63) Continuation of application No. 14/791,045, filed on Jul. 2, 2015, now abandoned, which is a continuation (Continued)

(51) Int. Cl.
*E04F 13/072* (2006.01)
*E04F 13/08* (2006.01)

(Continued)

(52) U.S. Cl.
CPC ..... *E04F 13/072* (2013.01); *B28B 1/14* (2013.01); *B44C 1/28* (2013.01); *E04F 13/0862* (2013.01);

(Continued)

(58) Field of Classification Search
CPC ..... B44C 1/00; B44C 1/24; B44C 1/28; B28B 23/0056; B28B 23/0075; B28B 19/00; B28B 19/0061; B28B 19/0069; E04F 21/16

(Continued)

(56) References Cited

U.S. PATENT DOCUMENTS 418,840 A * 1/1890 Hettich ..... B29C 45/14467 264/261
712,168 A 10/1902 Worth (Continued)

FOREIGN PATENT DOCUMENTS

| | | | |
|---|---|---|---|
| DE | EP 1175986 A1 * | 1/2002 | ..... B28B 19/0069 |
| EP | 1175986 A1 | 1/2002 | |
| WO | WO8501690 | 4/1985 | |

OTHER PUBLICATIONS

Steam Cleaning Concrete, Dec. 15, 2003, http://www.repair-home.com?Steam_Cleaning_Concrete.html; 3 Pages.

(Continued)

*Primary Examiner* — Babajide Demuren
(74) *Attorney, Agent, or Firm* — Stetina Brunda Garred and Brucker

(57) ABSTRACT

Provided is a method of installing a tile mosaic upon a vertical concrete surface. The method includes providing a plurality of tiles, a tile support, and a concrete form. The plurality of tiles are adhered to the tile support to define a mosaic assembly. The tiles are positioned on the tile support corresponding to the mosaic. The mosaic assembly is connected to the concrete form, and concrete is poured within the concrete form such that a portion of the tiles become embedded within the concrete. The tile support is subsequently detached from the concrete form and the concrete form is removed from the hardened concrete. The tile support is additionally removed from the plurality of tiles to reveal the mosaic on vertical surface of the concrete structure.

5 Claims, 4 Drawing Sheets

Related U.S. Application Data of application No. 14/157,438, filed on Jan. 16, 2014, now abandoned, which is a continuation of application No. 13/783,052, filed on Mar. 1, 2013, now abandoned, which is a continuation-in-part of application No. 13/294,434, filed on Nov. 11, 2011, now abandoned.

(51) Int. Cl.

| | |
|---|---|
| ***E04G 21/14*** | (2006.01) |
| ***B44C 1/28*** | (2006.01) |
| ***E04F 13/14*** | (2006.01) |
| ***E04F 19/00*** | (2006.01) |
| ***B28B 1/14*** | (2006.01) |
| ***E04F 15/12*** | (2006.01) |
| *E04F 19/04* | (2006.01) |

(52) U.S. Cl.

CPC ..... *E04F 13/0871* (2013.01); *E04F 13/141* (2013.01); *E04F 13/142* (2013.01); *E04F 13/147* (2013.01); *E04F 15/126* (2013.01); *E04F 19/00* (2013.01); *E04G 21/14* (2013.01); *E04F 2019/0418* (2013.01); *E04F 2019/0454* (2013.01)

(58) Field of Classification Search

USPC ..... 52/747.11, 746.12, 389, 384, 385, 388,52/311.1, 311.3, 315

See application file for complete search history.

(56) References Cited

U.S. PATENT DOCUMENTS

| | | | | | |
|---|---|---|---|---|---|
| 738,704 | A | | 9/1903 | Semmer | |
| 763,064 | A | | 6/1904 | Mercer | |
| 1,359,893 | A | | 11/1920 | Hopkins | |
| 2,266,510 | A | * | 12/1941 | Pottinger | B28B 19/0053 249/84 |
| 2,907,129 | A | | 10/1959 | Bedell | |
| 2,931,751 | A | | 4/1960 | Du Fresne | |
| 3,319,392 | A | | 5/1967 | Fitzgerald | |
| 3,384,982 | A | * | 5/1968 | Lawrence | A63F 9/06 156/63 |
| 3,622,656 | A | * | 11/1971 | Dewey, Jr. | B63B 1/041 264/309 |
| 3,646,715 | A | | 3/1972 | Pope | |
| 3,802,204 | A | | 4/1974 | Mason | |
| 4,076,875 | A | | 2/1978 | Van Gasse | |
| 4,094,110 | A | | 6/1978 | Dickens et al. | |
| 4,205,040 | A | | 5/1980 | Aoyama | |
| 4,270,789 | A | | 6/1981 | Cline | |
| 4,366,942 | A | | 1/1983 | Michienzi | |
| 4,748,788 | A | | 6/1988 | Shaw | |
| 4,947,600 | A | * | 8/1990 | Porter | E04F 13/0862 52/235 |
| 5,196,248 | A | * | 3/1993 | Danico | B44C 1/105 428/137 |
| 5,225,134 | A | * | 7/1993 | Nasvik | B28B 7/36 249/102 |
| 5,268,137 | A | * | 12/1993 | Scott | B28B 19/0061 249/112 |
| 5,335,472 | A | | 8/1994 | Phillips | |
| 5,398,472 | A | | 3/1995 | Eichelkraut | |
| 5,502,941 | A | * | 4/1996 | Zember | B28B 11/0818 427/282 |
| 5,673,489 | A | | 10/1997 | Robell | |
| 5,735,094 | A | * | 4/1998 | Zember | B28B 11/0818 427/282 |
| 5,794,401 | A | | 8/1998 | Shaw | |
| 5,803,964 | A | | 9/1998 | Scarborough | |
| 5,887,399 | A | | 3/1999 | Shaw | |
| 5,950,394 | A | | 9/1999 | Shaw | |
| 6,016,635 | A | | 1/2000 | Shaw | |
| 6,033,146 | A | | 3/2000 | Shaw | |
| 6,082,074 | A | | 7/2000 | Shaw | |
| 6,112,487 | A | | 9/2000 | Shaw | |
| 6,164,037 | A | | 12/2000 | Passeno | |
| 6,237,294 | B1 | * | 5/2001 | Rygiel | B28B 7/007 264/220 |
| 6,330,774 | B1 | | 12/2001 | Weinstein | |
| 6,630,041 | B1 | | 10/2003 | Reiber | |
| 6,785,992 | B2 | | 9/2004 | Chiarucci | |
| 6,834,438 | B1 | | 12/2004 | Heister | |
| 6,955,834 | B2 | | 10/2005 | Rohrbaugh et al. | |
| 7,242,799 | B1 | | 7/2007 | Bremsteller | |
| 7,493,732 | B2 | * | 2/2009 | Brailsford | B28B 23/0075 52/311.1 |
| 2003/0061722 | A1 | | 4/2003 | Bradley | |
| 2004/0216404 | A1 | | 11/2004 | Black | |
| 2006/0083591 | A1 | | 4/2006 | Shaw | |
| 2006/0157634 | A1 | * | 7/2006 | Nasvik | B28B 7/0073 249/16 |
| 2006/0180731 | A1 | * | 8/2006 | Scott | B28B 19/0061 249/15 |
| 2006/0233981 | A1 | * | 10/2006 | Straka | B28B 23/0075 428/34.4 |
| 2007/0101677 | A1 | * | 5/2007 | Brailsford | B28B 23/0075 52/747.11 |
| 2009/0071094 | A1 | | 3/2009 | Boxberger | |
| 2010/0051779 | A1 | | 3/2010 | McCary | |
| 2010/0251664 | A1 | * | 10/2010 | Pinto | E04F 21/161 52/749.1 |
| 2011/0056165 | A1 | * | 3/2011 | Charles, Jr. | B28B 7/0026 52/742.14 |

OTHER PUBLICATIONS

Cement and Concrete Basics, Aug. 22, 2004, http://www.cement.org/basics/concretebasics_placing.asp; 1 Page.

* cited by examiner

CONCRETE MOSAIC

CROSS-REFERENCE TO RELATED APPLICATIONS

This is a continuation application of U.S. application Ser. No. 14/791,045, filed Jul. 2, 2015, which is a continuation application of U.S. application Ser. No. 14/157,438, filed Jan. 16, 2014, which is a continuation-in-part of U.S. application Ser. No. 13/783,052, filed Mar. 1, 2013, which is a continuation-in-part of U.S. application Ser. No. 13/294,434, filed Nov. 11, 2011, the contents of which are expressly incorporated herein by reference.

STATEMENT RE: FEDERALLY SPONSORED RESEARCH/DEVELOPMENT

Not Applicable

BACKGROUND

1. Field of the Invention

The present invention relates in general to concrete products and more particularly to methods for creating an aesthetic surface on a concrete product, including fabricating a module for use in creating the aesthetic surface upon a generally vertical concrete face and a method of installing the aesthetic surface upon the generally vertical concrete face utilizing the module.

2. Description of the Related Art

As is well known in the building and construction trade, concrete is extensively utilized as a building material for industrial, commercial and residential applications. Due to its durability, water resistance, and cost economy, concrete has gained wide spread use. With this widespread use, the public is currently demanding variations in color, surface texture and overall appearance of concrete so that the concrete possesses improved aesthetics similar to more conventional and costly surfaces such as stone, mosaic, and terrazzo.

In order to meet this demand, the concrete trade has developed various coloring and surface finishing techniques to enhance the aesthetics of concrete. Examples of such finishing techniques include salt finish, multiple broom finish, form press finish (e.g. stamped concrete), and exposed aggregate finish.

In addition to the extensive use of concrete in building and construction, the use of mosaics in flooring, walls, and other decorative structures and elements has also become significantly widespread. Such products typically include a picture or decorative design. The design is made by completing several steps. First, with regard to flooring, for example, the flooring surface must be prepared, which may include leveling the surface. Secondly, an adhesive, such as mortar or a tile adhesive, is spread upon the surface. After the adhesive is in place, small individual colored mosaic pieces, such as stone or tile, are set into the surface. Once the adhesive is substantially dried, a grouting product is then set between the mosaic pieces to create a uniform surface and further secure the mosaic pieces to the surface. The resultant product is frequently very beautiful and may be very ornate and detailed. However, due to the extensive amount of time and several additional steps that such a product requires in comparison to other flooring products, mosaic flooring are usually quite expensive. Further, construction of mosaics in walls and other decorative structures and elements may also be quite laborious and expensive.

Although concrete and mosaic products have advanced significantly over recent years to meet the demands of customers and innovative builders, there is no current concrete product for use in flooring, walls, or other decorative structures and elements that makes the creation of mosaics more affordable or efficient than the basic process described above.

Therefore, there exists a need in the art for an improved process of creating mosaic products that is more cost and time efficient, particularly for creating a mosaic upon a vertical surface. Various aspects of the present invention are directed toward addressing this particular need, as will be discussed in more detail below.

BRIEF SUMMARY

According to various aspects of the present invention, there is provided a method of installing a tile mosaic upon a vertical concrete surface. In general, the method includes forming the mosaic on a template and securing the template to a concrete form used to frame the concrete surface. After the concrete has been poured and hardens, the form and template may be removed to reveal the mosaic, which is embedded within the hardened concrete. The method advantageously provides a quick and easy process by which a template may be formed on a generally vertical concrete surface. Furthermore, it is contemplated that the template may be easily constructed off-site and subsequently transported to the construction site for implementation into the concrete surface. As such, valuable space at the construction site may not be required for construction of the mosaic template.

According to one embodiment, the method includes providing a plurality of tiles, a tile support, and a concrete form. The plurality of tiles are adhered to the tile support to define a mosaic assembly. The tiles are positioned on the tile support corresponding to the mosaic. The mosaic assembly is connected to the concrete form, and concrete is poured within the concrete form such that a portion of the tiles become embedded within the concrete. The tile support is subsequently detached from the concrete form and the concrete form is removed from the hardened concrete. The tile support is additionally removed from the plurality of tiles to reveal the mosaic on vertical surface of the concrete structure.

It is contemplated that the concrete form may be stripped or removed while the concrete is in a semi-plastic state. A float may be passed over the tile/concrete surface to create a more uniform surface. Furthermore, a brush, sponge, power washer and/or surface retarder may be used to expose the surface of the concrete.

It is additionally contemplated that various aspects of the present invention are directed toward forming an aesthetic surface on a structure which does not include a face form, such as a structure formed from Shotcrete, Gunite, or the like. The method includes the steps of providing a plurality of aesthetic elements and a support mesh, and adhering the aesthetic elements to the support mesh with a water soluble adhesive. A concrete material is disposed on a base surface, with the concrete material defining an exposed surface. The aesthetic elements are then placed within the exposed surface of the concrete material.

The method may include pneumatically projecting the concrete material onto the base surface. A hose may be used to convey the concrete material from a pressurized source of the concrete material to the base surface.

The step of placing the aesthetic elements in the concrete material may include placing the mesh within the cement mixture.

The method may also include removing the mesh from the aesthetic elements.

The present invention is best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which like numbers refer to like parts throughout, and in which.

Common reference numerals are used throughout the drawings and detailed description to indicate like elements.

DETAILED DESCRIPTION

Figure 1:
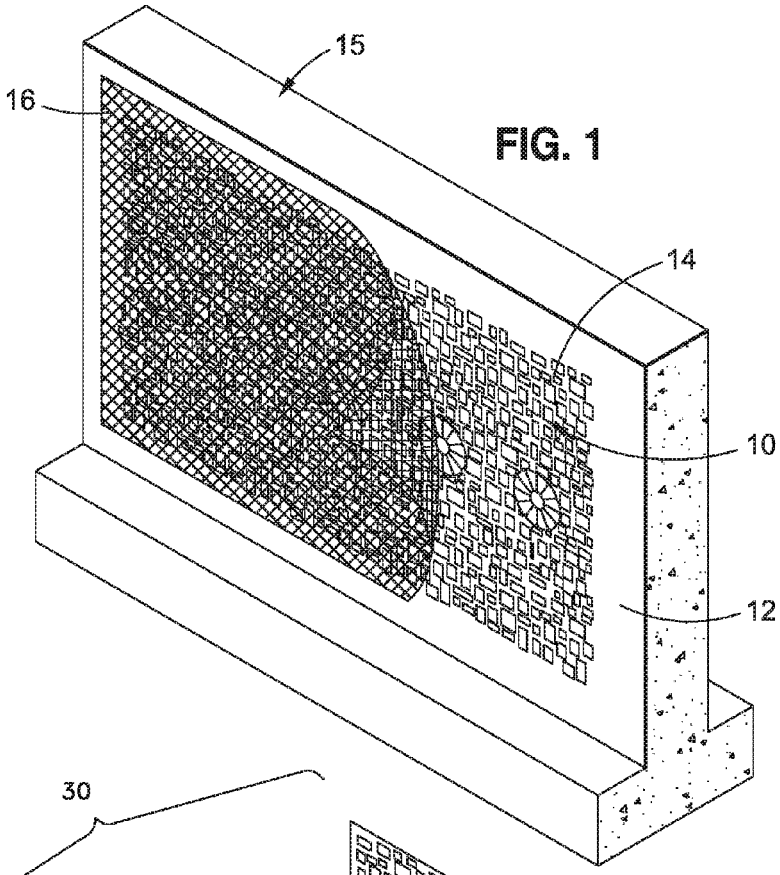
FIG. 1 is an upper perspective view of a tile mosaic being installed on a vertical concrete surface.

The detailed description set forth below is intended as a description of the presently preferred embodiment of the invention, and is not intended to represent the only form in which the present invention may be constructed or utilized. The description sets forth the functions and sequences of steps for constructing and operating the invention. It is to be understood, however, that the same or equivalent functions and sequences may be accomplished by different embodiments and that they are also intended to be encompassed within the scope of the invention.

Referring now to the drawings wherein the showings are for purposes of illustrating a preferred embodiment of the invention only, and not for purposes of limiting the same, FIGS. 1-3D show a system and method of creating and installing a mosaic 10 upon a concrete surface 12, particularly a vertical concrete surface 12. The mosaic 10 includes a plurality of tiles 14 which are secured or adhered to a template or tile support 16. The tile support 16 is placed adjacent the concrete form used to define the vertical face of the concrete structure 15 during formation of the concrete structure 15. In a preferred embodiment, the tile support 16 is connected to the concrete form. Concrete is then poured into the form and is allowed to harden/set-up/retain its shape. As the concrete sets-up or hardens, the tiles 14 become embedded within the concrete, while a portion of the tile 14 remains exposed. After the concrete has hardened, the form is removed from the concrete structure 15 and the tile support 16 is separated from the tiles 14. The result is a vertical concrete surface 12 having a plurality of tiles 14 embedded therein which collectively define the mosaic 10.

As used herein, the word "vertical" refers to a direction having a directional component aligned with an axis defined by the force of gravity (i.e., the gravitational axis). A vertical face may extend generally upward from a lower support, or generally downward from an upper support. "Vertical" may also indicate a direction that is substantially perpendicular to the horizontal. Along these lines, a vertical surface is not limited to being substantially upright or perpendicular to the horizontal. In this regard, the vertical surface may be slightly offset from the perpendicular to the horizontal.

Furthermore, as used herein, the word "tile" may refer to any aesthetic element adhered to a support mesh/tile support 16. The tile/aesthetic element 14 may include aggregates, stones, shells, glass, other aesthetic materials known by those skilled in the art, and combinations thereof.

Figure 3A:
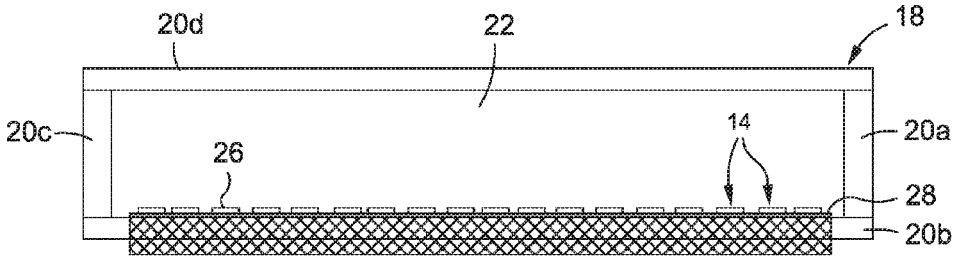
FIG. 3A is a top view of a concrete form defining a pour area, with the tile support and mosaic tiles disposed inside the pour area adjacent the form, the tiles being secured to the tile support via an adhesive.
Figure 3B:
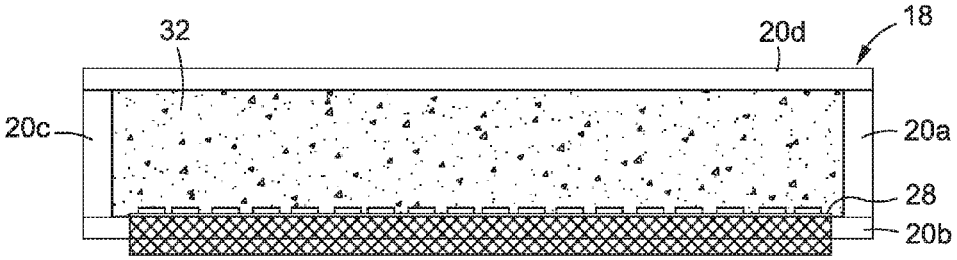
FIG. 3B is a top view similar to FIG. 3A, with concrete poured into the pour area defined by the concrete form.
Figure 3C:
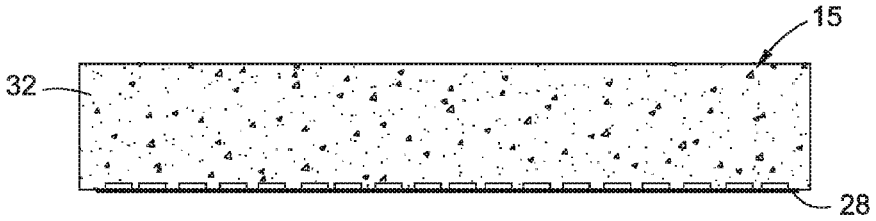
FIG. 3C is a top view similar to FIG. 3B with the concrete hardened and the form and tile support removed from the hardened concrete and mosaic tiles.

Referring now to FIG. 3A, there is shown a concrete form 18 including form members 20*a*-20*d* for constructing a concrete structure 15, such as a concrete wall similar to the concrete structure 15 shown in FIG. 1. The form members 20*a*-20*d* may be formed from wood, plastic, or other materials known in the art. The form 18 is placed upon a base or ground surface, and defines a pour cavity 22 corresponding to the concrete structure 15. The form 18 shown in FIGS. 3A and 3B includes four form members 20*a*-20*d*, which collectively define the pour cavity 22. Each form member 20*a*-20*d* defines an inner face and an outer face, with the inner faces of the form members 20*a*-20*d* defining the pour cavity 22. Form member 20*b* may be generally referred to as the "face form" because it corresponds to the face of the concrete structure. Although the form members 20*a*-20*d* shown in FIGS. 3A and 3B are planar, it is additionally contemplated that other embodiments may include form members 20*a*-20*d* that define other shapes and configurations, such as arcuate or rounded sections. Furthermore, the form 18 shown in FIGS. 3A and 3B defines a pour cavity 22 that is completely circumscribed by the concrete form 18, however, it is understood that the form 18 may only partially circumscribe the cavity 22. For instance, the form 18 may be placed against an existing structure, wherein a portion of the existing structure defines a portion of the cavity 22. The form members 20*a*-20*d* defining the form are held together by mechanical fasteners, such as nails or screws, to define the cavity 22 within which the concrete is poured.

The mosaic 10 is comprised of a plurality of tiles 14 which may collectively form an artistic or decorative pattern. It is also contemplated that the mosaic 10 may include a random arrangement of aesthetic elements or tiles 14. The transfer of the tiles 14 to the concrete structure 15 is facilitated by the use of a support mesh or tile support 16 to which the tiles 14 are preferably temporarily adhered. The tile support 16 may include a porous material, such as mesh, cloth or paper that is strong enough to support the plurality of tiles 14 included in the mosaic design. As will be described in more detail below, the tiles 14 are adhered to the tile support 16 to maintain the tiles 14 in position while the concrete is poured into the pour cavity 22, as well as maintaining the tiles 14 in position during the hardening process.

Figure 3D:
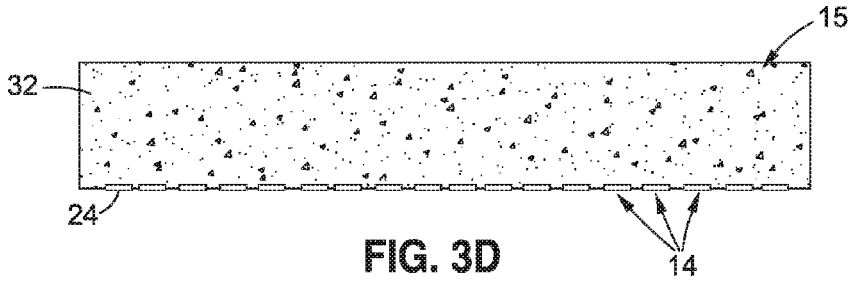
FIG. 3D is a top view similar to FIG. 3C with the adhesive removed from the tiles.
Figure 4:
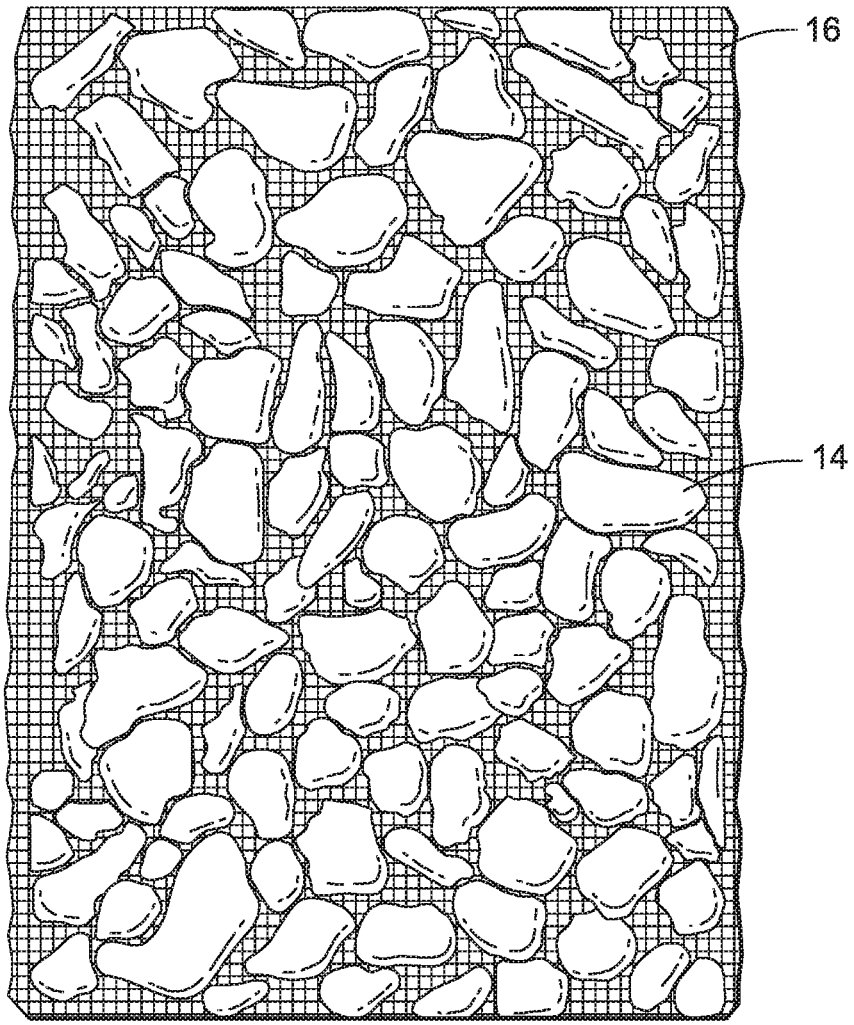
FIG. 4 is a front view of a mesh having aggregate adhered thereto in a random fashion.

Referring now to FIGS. 3A and 3D each tile 14 includes an exposed surface 24 (See FIG. 3D) and an embedded surface 26 (See FIG. 3A). The tiles 14 are configured to be placed within the concrete structure such that the embedded surface 26 is embedded within the concrete, while the exposed surface 24 remains exposed to contribute to the overall appearance of the mosaic 10. The tiles 14 may be formed of ceramic, glass, stone, shell, and/or brick tile pieces, and any other variety of ornamental material or combinations thereof. Furthermore, the tiles 14 are preferably configured to withstand the environmental conditions associated with the location of the concrete structure 15. For instance, if the concrete structure 15 is located outside, the tiles 14 should be configured to endure extended periods of exposure to the sunlight, as well as temperature changes, precipitation, or other conditions commonly associated with the local environment. A protective coating may be applied to the tiles 14 to provided added protection from the environmental elements.

According to one embodiment, the exposed surfaces 24 of the tiles 14 are temporarily adhered to the tile support 16. When the exposed surfaces 24 of the tiles 14 are adhered to the tiles support 16, the tiles 14 are arranged on the tile support 16 in a "reverse image" configuration, such that when the tiles 14 are placed onto the vertical surface 12, the tiles 14 appear in the correct configuration. However, as noted above, the tiles 14 may also be arranged in a random fashion on the vertical surface 12 of the concrete structure 15.

An adhesive 28 may be disposed between the tiles 14 and the tile support 16 to temporarily adhere the tiles 14 to the tile support 16. The adhesive 28 is preferably a water soluble adhesive 28 to facilitate separation of the tile support 16 from the tiles 14 after the concrete hardens and the tiles 14 are embedded within the concrete structure.

In one particular implementation, the adhesive 28 is disposed on the tile support 16 prior to placing the tiles 14 on the tile support 16 in the mosaic arrangement, i.e., arranged to a define a pattern or shape, or alternatively in a random arrangement. In this regard, it may be easier to apply the adhesive 28 to the tile support 16, rather than applying the adhesive 28 to each tile 14 individually. After the adhesive 28 is completely disposed on the tile support 16, the tiles 14 are then placed on the tile support 16.

According to another implementation, the adhesive 28 is applied to the exposed surface 24 of the tiles 14 before the tiles 14 are placed on the tile support 16. Applying the adhesive 28 to each individual tile 14 may result in a more efficient use of the adhesive 28 (i.e., less adhesive 28 may be used). After the adhesive 28 has been placed on the tiles 14, the tiles 14 may be placed upon the tiles support 16, with the adhesive 28 being disposed between the exposed surface 24 of the tiles 14 and the tile support 16.

Figure 2:
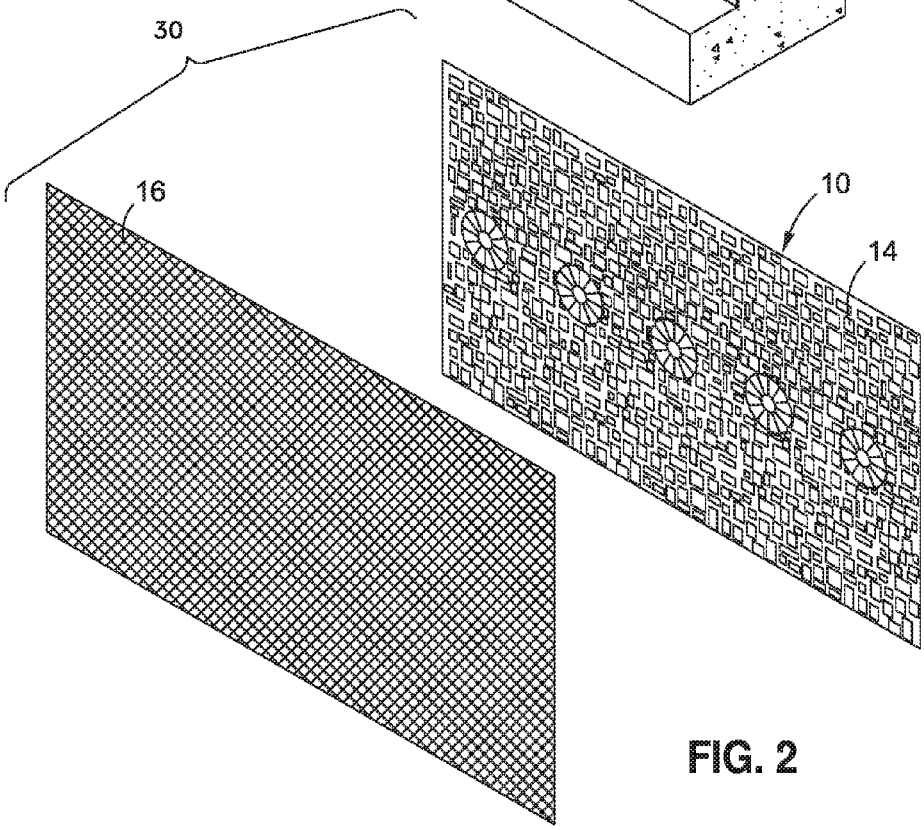
FIG. 2 is an upper perspective view of a plurality of tiles which collectively define the mosaic, and a mesh tile support for installing the tiles on the concrete surface.

The tile support 16 and the tiles 14 placed on the tile support 16 collectively define a mosaic assembly 30 (See FIG. 2). The mosaic assembly 30 is connected to the inner face of the form 18 to dispose the mosaic assembly 30 within the pour cavity 22. In the exemplary embodiment, the tile support 16 is connected to face form 20*b*. The mosaic assembly 30 is arranged with the embedded surfaces 26 of the tiles 14 facing into the cavity 22 and the exposed surfaces 24 of the tiles 14 facing out of the cavity 22 (i.e., toward the adjacent form member). The tile support 16 is disposed between the tiles 14 and the concrete form 18. According to one implementation, the tile support 16 may be secured to the concrete form 18 via mechanical fasteners, such as nails, screws, rivets, staples, adhesives, etc., or may be tied to the form 18, or otherwise secured thereto using techniques known in the art.

The concrete 32 is poured into the pour cavity 22 and is allowed to settle and set-up/harden. During at least a portion of the hardening process, the mosaic assembly 30 remains adjacent the inner surface of the form 18. It is contemplated that the exposed surface 24 of the tiles 14 may become partially or completely embedded within the concrete 32 when the concrete 32 is poured into the cavity 22. However, as discussed in more detail below, a finishing process may be performed to remove a portion of the concrete 32 and thereby uncover the exposed surfaces 24.

After the concrete 32 has been poured, the form 18 and tile support 16 are removed from the concrete structure and the tiles 14. According to one implementation, the form 18 is removed while the concrete is in a semi-plastic state. The tile support 16 may be configured to peel away from the tiles 14 when the form 18 is removed from the concrete structure. In other words, the tile support 16 and the form 18 may be removed at the same time. In an alternate embodiment, the concrete form 18 and tile support 16 are removed separately. Along these lines, the concrete form 18 is first removed from the concrete structure by separating the tile support 16 from the form 18, and then removing the form 18 from the concrete structure. Subsequently, the tile support 16 may be removed from the tiles 14. To this end, the adhesive 28 binding the tile support 16 to the tiles 14 may be dissolved or otherwise rendered inoperable by spraying water or applying another agent onto the tile support 16. After the adhesive 28 has been dissolved, the tile support 16 may be separated from the tiles 14, leaving the tiles 14 embedded within the concrete 32.

An optional finishing step may be performed to the concrete structure and the tiles 14 after the form 18 has been removed. For instance, a float may be passed over the tiles 14 and concrete before the concrete sets up, so as to create a more uniform surface. The concrete structure may be sandblasted, acid washed, brushed, sponged, or power washed to remove the top layer of concrete 32, which may further uncover the tiles 14 to more prominently display the mosaic 10, as well as to expose the concrete fines to produce a more aesthetic appearance. In addition, a surface retarder may be applied to the form 18 or concrete directly to more prominently display the mosaic 10.

The foregoing describes a method of connecting the tiles 14 to the tile support 16 wherein the exposed surfaces 24 of the tiles 14 are connected to the tile support 16 (referred to as an "outer support" method because the "outer" portion of the tiles 14 are connected to the tile support 16). The following describes an alternative method wherein the embedded surface 26 of the tiles 14 are connected to the tile support 16 (referred to as an "inner support" method because the "inner" portion of the tiles 14 are connected to the tile support 16).

According to the inner support method, the embedded portions 26 of the tiles 14 are coupled to the tile support 16. The tiles 14 may be more permanently adhered to the tile support 16 because the tile support 16 may be embedded within the concrete structure with the tiles 14 in the finished product. In other words, the tile support 16 may not be separated from the tiles 14 after the concrete structure has hardened. However, the adhesives 28 described above in relation to the outer support method may also be used for the inner support method.

Given that the embedded portion 26 of the tiles 14 are connected to the tile support 16, the tiles 14 may be placed on the tile support 16 in the configuration which they are to be displayed on the vertical surface 12. In other words, the tiles 14 do not need to be placed in the "reverse" configuration as discussed above in relation to the outer support method. Rather, the tiles 14 can be placed as they will appear in the mosaic 10 on the vertical wall 12.

After the tiles 14 are adhered to the tile support 16 to define the mosaic assembly 30, the mosaic assembly 30 is disposed within the pour cavity 22 adjacent the inner surface of the concrete form 18. The tile support 16 may be attached to the concrete form 18, or to another readily available anchor point. Alternatively, the tile support 16 may have enough rigidity to support itself, i.e., without being anchored to a separate structure. For instance, the tile support 16 may be formed from a wire mesh having an internal rigidity sufficient for supporting the mosaic assembly 30 in an upright, standing configuration.

After the mosaic assembly 30 is disposed within the pour cavity 22, the concrete 32 is poured and is allowed to harden/set-up. The mosaic assembly 30 is positioned within the pour cavity 22 such that when the concrete 32 hardens, the exposed surfaces 24 of the tiles 14 are exposed and the embedded portions 26 of the tiles 14 are embedded within the concrete 32. After the concrete 32 hardens, the concrete form 18 is removed and the finishing steps described above may be performed to the concrete structure.

The foregoing generally describes the steps of forming the aesthetic surface on the concrete structure 15. However, there are slight modifications to the process depending on whether the wall is "short" or "tall." According to one embodiment, a short wall is a wall up to eight (8) feet, while a tall wall can range anywhere from four (4) feet to twenty (20) feet, and in some cases higher. For shorter walls, the concrete form 18 may be stripped from the concrete structure 15 on the same day that the concrete is poured. In this regard, the concrete form 18 may be stripped within 24 hours after the concrete is poured. It is also contemplated that the concrete form 18 may be stripped within 18 hours or even 12 hours of pouring the concrete.

After the concrete form 18 is stripped, the aesthetic surface may be floated or trowelled and the tiles/aggregates 14 may be exposed. The concrete surface 12 may be sponged to expose the tiles/aggregates 14. The concrete structure 15 may then be allowed to harden.

With regard to taller walls, the concrete form 18 may be stripped a day after the concrete is poured into the form 18, in particular, more than 24 hours after the concrete is poured into the form 18. After the form 18 is stripped, the concrete structure 15 may be washed with a surface retarder to expose the aggregates 14. The concrete structure 15 may then be allowed to harden.

The foregoing description relates to cast-in-place concrete structures which utilize a face form to contain concrete poured into the form during the formation process. As noted above, the face form may used as an anchor or base structure to which the mosaic assembly may be fastened or connected. However, it is understood that other concrete/cement products, such as Shotcrete, Gunite, or the like, do not require a face form due to its low slump concrete mix (i.e., the mixture generally does not flow once it is projected onto a surface). Therefore, other aspects of the present invention relate to forming the aesthetic surface on a concrete/cement structure formed with Shotcrete, Gunite, or similar materials known in the art, which are typically not shaped with a face form. In such structures, the mosaic assembly is not connected to a face form (due to the absence of a face form), and instead, the mosaic assembly is worked directly into the exposed surface of the concrete/cement material.

Figure 5:
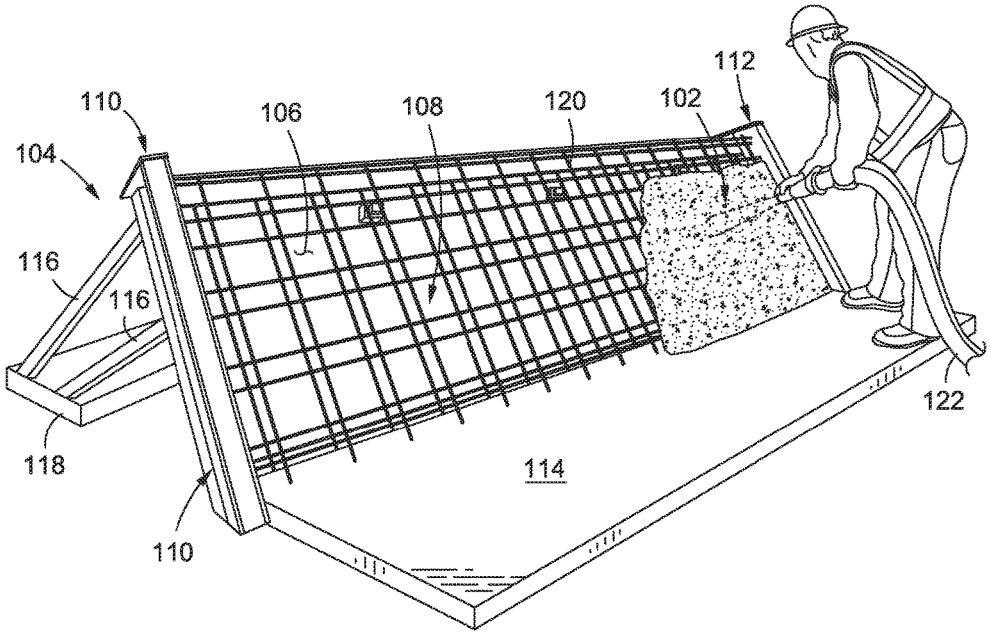
FIG. 5 is an upper perspective view of a concrete mixture being pneumatically conveyed onto a back form.
Figure 6:
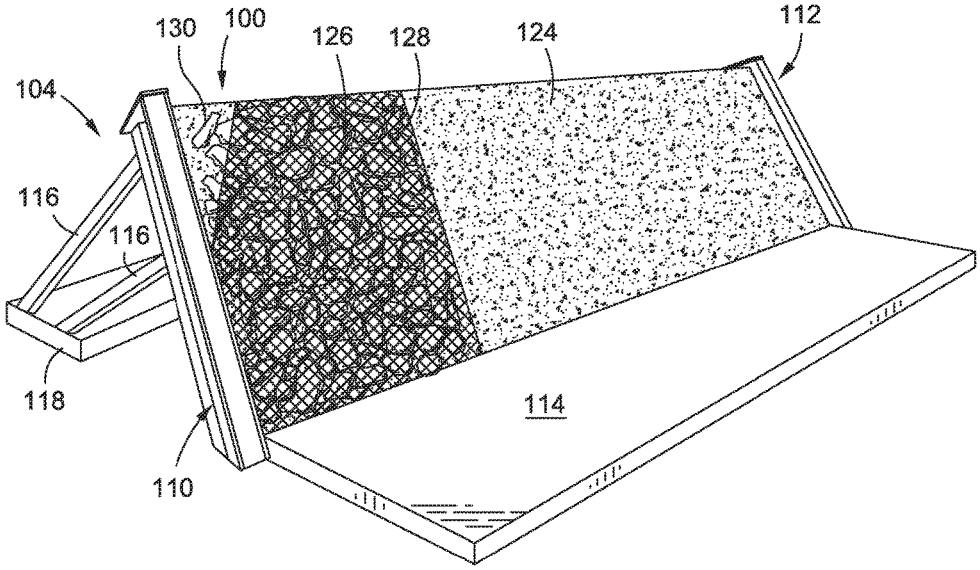
FIG. 6 is an upper perspective view of a mosaic assembly formed within a portion of the concrete mixture.

Referring now specifically to FIGS. 5 and 6, there is shown a method of creating an architectural mosaic 100 on a structure formed from a concrete mixture 102, such as Shotcrete, Gunite, or the like. The method includes constructing a back form 104 to define a cavity 106 within which the concrete mixture 102 is dispensed. The exemplary back form 104 includes a rear form member 108 extending between first and second side form members 110, 112. A lower support/lower form member 114 also extends partially between the first and second side form members 110, 112 and may additionally contribute to defining the cavity 106.

As shown in FIGS. 5 and 6, the back form 104 may be elevated from the ground to define an angled configuration. The back form 104 may be supported by one or more support members 116, which extend between the back form 104 and a support base 118, which resides on the ground.

Reinforcement members 120, i.e., rebar, may be placed within the cavity 106 to enhance the structural strength of the concrete structure. The reinforcement members 120 may be arranged in an intersecting pattern to define a lattice framework, as shown in FIG. 5.

With the back form 104 constructed and properly positioned, the concrete material may be dispensed into the cavity 106. FIG. 5 shows a construction worker manipulating a dispensing hose 122 which projects the concrete mixture 102 into the cavity 106. The dispensing hose 122 is aimed at the cavity 106 to project the concrete mixture 102 into the cavity 106. In this regard, the hose 122 is fluidly connected to a pressurized source of the concrete mixture 102 so as to pneumatically project the concrete mixture 102 into the cavity 106. As the concrete mixture 102 is dispensed in the cavity 106, the rebar members 120 become encapsulated within the concrete mixture 102. As noted above, due to the low slump of the concrete mixture 102, the concrete mixture 102 generally does not flow out of the cavity 106 after it is dispensed into the cavity 106.

When the cavity 106 is filled with the concrete mixture 102, the concrete mixture 102 defines an exposed surface 124, which extends between the first and second side form members 110, 112. The exposed surface 124 may be floated or trowelled to define a smooth surface. The mosaic assembly 126 is then placed within the exposed surface 124 of the concrete mixture 102. As described in more detail above, the mosaic assembly 126 includes a mesh base 128 and a plurality of aesthetic elements 130 coupled to the mesh base 128. The aesthetic elements 130 may be arranged according to a specific design or pattern; or alternatively, the aesthetic elements 130 may be randomly positioned on the mesh base 128. Furthermore, the aesthetic elements 130 may include rocks, stones, aggregates, shells, glass fragments, tiles, bricks, ceramic pieces and/or other aesthetic elements known by those skilled in the art.

It is contemplated that the mosaic assembly 126 may be arranged in several different orientations to effectuate placoncrete of the mosaic within the concrete mixture 102. According to one embodiment, and as shown in FIG. 6, the mosaic assembly 126 is pressed into the concrete mixture 102 with the aesthetic elements 130 residing between the concrete mixture 102 and the mesh base 128. In other words, the aesthetic elements 130 are "underneath" the mesh base 128 as the mesh base 128 is pressed toward the concrete mixture 102. This is analogous to the "reverse image" configuration noted above, wherein the exposed surfaces of the aesthetic elements 130 are connected to the mesh base 128, and the embedded surface of the aesthetic elements 130 face away from the mesh base 128.

The mosaic assembly 126 is pressed into the concrete mixture 102 until the aesthetic elements 130 are sufficiently embedded within the concrete mixture 102. Preferably, a portion of the aesthetic element 130 remains exposed and may partially protrude from the exposed surface 124 of the concrete mixture 102. Furthermore, the mesh base 128 is preferably not embedded within the concrete mixture 102. Along these lines, the mesh base 128 is disconnected from the aesthetic elements 130 and is peeled away to expose the aesthetic elements 130 and the concrete mixture 102. According to one embodiment, the aesthetic elements 130 may be connected to the mesh base 128 via a water soluble adhesive which is deactivated or dissolved by pouring or spraying water over the mosaic assembly 126. Once the adhesive is dissolved, removed or otherwise deactivated, the mesh base 128 may be easily removed from the aesthetic elements 130.

According to another embodiment, the mosaic assembly 126 may be pressed into the concrete mixture 102 such that the aesthetic elements 130 are "on top" of the mesh base 128 as the mosaic assembly 126 is pressed into the concrete mixture 102. This is contrasted with the embodiment described above, wherein the aesthetic elements 130 reside "underneath" the mesh base 128 as the mosaic assembly 126 is pressed into the concrete mixture 102. The "on top" configuration is analogous to the "inner support" method described above because the inner/embedded portion of the aesthetic elements 130 are connected to the mesh base 128. In the "on top" configuration, the mosaic assembly 126 is pressed into the concrete mixture 102 such that the mesh base 128 becomes embedded therein. The mesh base 128 is preferably worked into the concrete mixture 102 until it is no longer visible. The aesthetic elements 130 also become embedded within the concrete mixture 102, although at least a portion of the aesthetic elements 130 remain visible and preferably protrude from the exposed surface 124.

After the aesthetic elements 130 are embedded within the concrete mixture 102, the aesthetic elements 130 may be further exposed by sponging, using a surface retarder, sandblasting or other methods/techniques known by those skilled in the art. The concrete structure may then be allowed to harden, and then the structure may be washed and sealed.

It should be noted that although the embodiment depicted in FIG. 6 only shows a mosaic design embedded into a portion of the exposed surface 124, it is contemplated that the mosaic design may extend across the entire exposed surface 124.

The above description is given by way of example, and not limitation. Given the above disclosure, one skilled in the art could devise variations that are within the scope of the invention disclosed herein, including various ways of creating different textures, colors, patterns, utilizing various types of mosaic pieces, etc. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A method of forming an aesthetic surface on a structure, the method comprising the steps of:

adhering a plurality of aesthetic elements to a support mesh with an adhesive;

constructing a concrete form having a base surface and a cavity at least partially defined by the base surface, the base surface being elevated relative to a horizontal plane to define a vertical component;

pneumatically projecting a concrete material into the cavity and on the base surface, the concrete material defining an exposed surface formed independent of a face form; and placing the aesthetic elements within the exposed surface of the concrete material substantially immediately after disposing the pneumatically projected concrete material on the base surface.

2. The method recited in claim 1, wherein the step of pneumatically projecting the concrete material onto the base surface includes aiming a hose connected to a pressurized source of the concrete material toward the base surface.

3. The method recited in claim 1, further comprising the step of removing the mesh from the aesthetic elements.

4. The method recited in claim 1, further comprising the step of placing the mesh within the concrete mixture.

5. The method recited in claim 1, wherein the concrete material is gunite.

* * * * *